US006446314B1

(12) United States Patent
Anscher

(10) Patent No.: US 6,446,314 B1
(45) Date of Patent: Sep. 10, 2002

(54) PUSH RELEASE BUCKLE WITH IMPROVED LATCHING CAPABILITY

(76) Inventor: Joseph Anscher, 1928 Midlane Rd., Muttontown, NY (US) 11791

( * ) Notice: Subject to any disclaimer, the term of this patent is extended or adjusted under 35 U.S.C. 154(b) by 0 days.

(21) Appl. No.: 09/635,595

(22) Filed: Aug. 9, 2000

(51) Int. Cl.[7] ..... A44B 11/26
(52) U.S. Cl. ..... 24/614; 24/625
(58) Field of Search ..... 24/614, 615, 616, 24/625, 606, 607, 634, 635

(56) References Cited

U.S. PATENT DOCUMENTS 4,866,819 A * 9/1989 Kasai
5,291,641 A * 3/1994 Morino
5,322,037 A * 6/1994 Tozawa
5,327,619 A * 7/1994 Ortega
5,443,039 A * 8/1995 Suchowski
5,465,472 A * 11/1995 Matoba
5,507,076 A * 4/1996 Anscher
5,542,161 A * 8/1996 Anscher
5,546,642 A * 8/1996 Anscher
5,551,131 A * 9/1996 Anscher
5,659,931 A * 8/1997 Anscher
5,794,316 A * 8/1998 Anscher

* cited by examiner

*Primary Examiner*—James R. Brittain
(74) *Attorney, Agent, or Firm*—Kenyon & Kenyon

(57) ABSTRACT

A buckle having a socket member and a plug member which may be coupled to the socket member. Latching surfaces on the plug member are formed on in resiliently flexible legs which extend from the base of the plug member. The socket member includes stopping members for engaging the latching surfaces of the legs in order to couple the plug member to the socket member. A button formed on the socket member includes a releasing member which is pushed down into the socket and forced into a space between the legs, thereby forcing the flexible legs to bend outwardly. As the legs are forced outwardly, eventually their latching surfaces clear the stopping members, and the plug member is released from the socket. The resiliently flexible nature of the legs provides a force upon disengagement of the latching surfaces from the post, which causes the plug member to spring out of the socket.

18 Claims, 7 Drawing Sheets

PUSH RELEASE BUCKLE WITH IMPROVED LATCHING CAPABILITY

FIELD OF THE INVENTION

The invention relates to a buckle which attaches two straps together, wherein the buckle is disengaged or opened by pushing on a centrally located button or flap. More particularly, the invention relates to such a buckle having an improved latching capability.

DESCRIPTION OF RELATED ART

Conventional buckles for securely attaching straps so that the buckle can be released are described, for example, in U.S. Pat. No. 5,659,931 which is directed to a three-piece buckle in which a centrally disposed socket member receives a pair of plug members through open opposite ends thereof. Each of the plug members and socket member has a cross bar to which can be attached a strap. The socket member defines a channel therethrough which is adapted to receive a portion of the plug members when the buckle pieces are coupled to one another. Each plug member has a tongue which defines a latching surface, which is adapted to engage with a stopping member in the socket. The tongues are resiliently flexible, so that as they slide into the socket member their latching surfaces can snap onto the stopping members inside the socket, and thereby lock the buckle in a closed position.

Conventional buckles are released by pushing down on the resiliently flexible tongues so as to disengage the latching surfaces of the tongues from the stopping members in the socket, thereby releasing the plug members from the socket. A pair of legs, which run parallel to the tongue on opposite sides thereof in each plug member, facilitate removal of the plug members from the socket because they flex inwardly when they are-inserted into the socket and thereby urge the plug members out of the socket when they are released by depression of the tongues. However, the legs do not latch or lock the plug members in the socket. The latching function is performed exclusively by the tongues and the stopping members in the socket.

Buckles of the aforementioned type have been used in a variety of applications, such as in backpacks, luggage, children's seating products, such as high chairs and baby carriages.

Although buckles of the aforementioned type are suitable for many applications, one drawback associated with their use is that they are somewhat awkward to release. This difficulty is attributable to the nature of the latching mechanism, and in particular to the use of the tongues to accomplish this function. As discussed above, the tongues must be resiliently flexible so that they can flex over the stopping members or engagement members in the socket and then snap back into position. However, it is difficult to make the tongues sufficiently flexible, because they are relatively large and are attached to the base of the plug members along a relatively long edge or surface of the plug member. The resistance of the tongues to flexing or bending thus makes release of the buckle difficult.

SUMMARY OF THE INVENTION

The present invention is a buckle to attach a pair of straps, which is more easily releasable than conventional buckles. Exemplary embodiments of the invention include, in one aspect, a buckle comprising a plug member having a base portion, at least one resiliently flexible locking leg extending from the base portion of the plug member, each of the locking legs defining a latching surface and an angled surface, a socket member defining a cavity therein and an opening to the cavity and a stopping post extending into the cavity from a surface of the socket member, said stopping post defining an engaging surface. The buckle also includes a disengaging member linked to the socket member, such that the disengaging member is movable within the cavity of the socket member, wherein the at least one locking leg is adapted to slidably enter the cavity of the socket member through the opening, to deflect around the angled surface of the stopping post, and to engage with the latching surface the engaging surface of the stopping post, so as to couple the plug member to the socket member. In the buckle, the disengaging member is adapted to disengage the latching surface of the at least one locking leg from the engaging surface of the stopping post, and thereby permit decoupling of the plug member from the socket member.

BRIEF DESCRIPTION OF THE DRAWINGS

Other features and advantages of the invention will be more fully appreciated from the following detailed description of the embodiments, when considered in connection with the accompanying drawings.

In the Drawings.

DETAILED DESCRIPTION OF THE INVENTION

Figure 1:
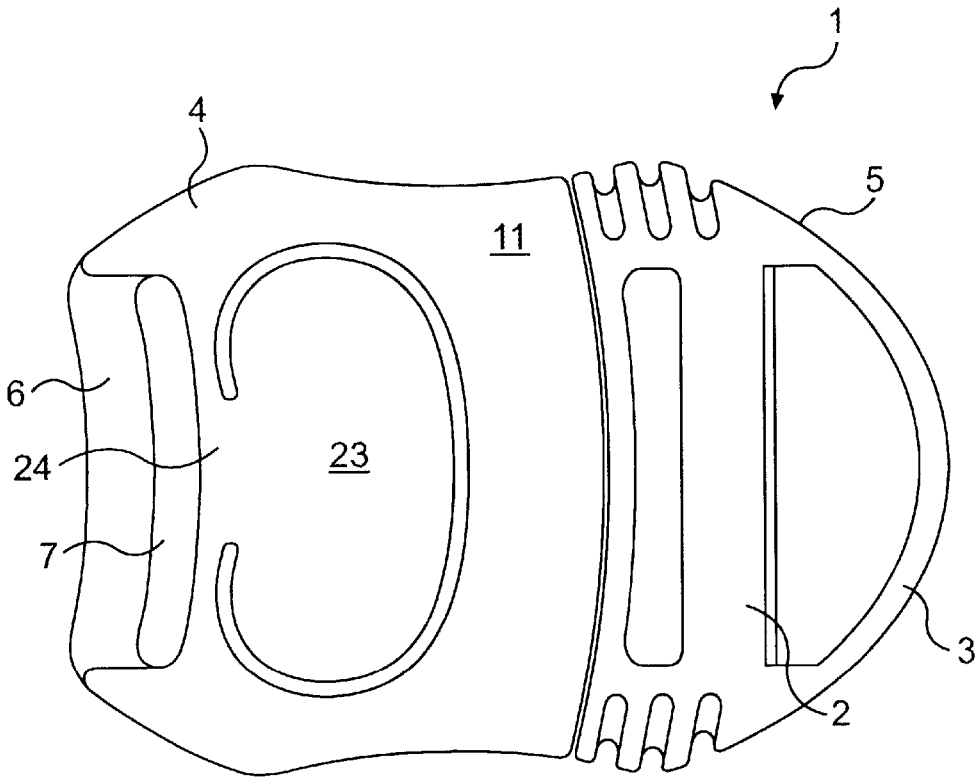
FIG. 1 is a top plan view of a buckle according to an embodiment of the invention, showing the two joined portions.
Figure 2:
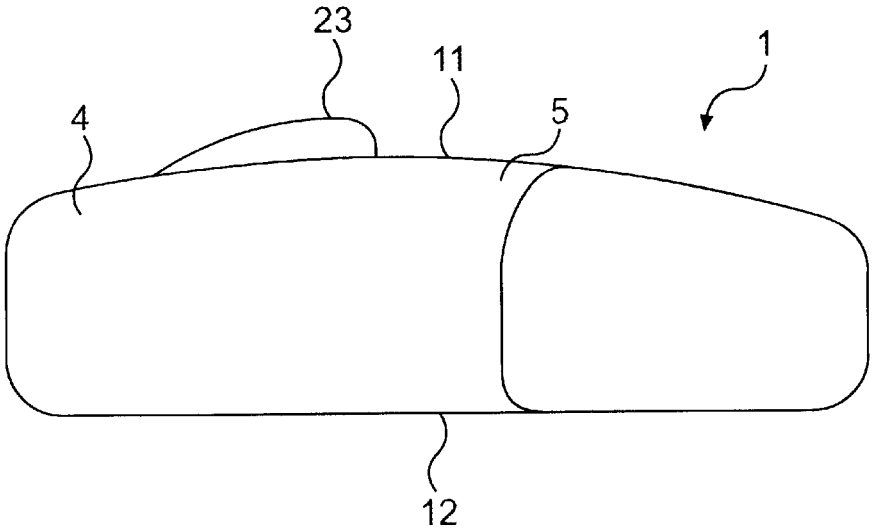
FIG. 2 is a side elevation view of the buckle shown in FIG. 1.

Referring to FIGS. 1 and 2, a buckle in accordance with the invention is designated generally by the reference numeral 1. The buckle 1 is typically used to connect free ends of straps (not illustrated). The buckle 1 comprises two pieces, a female socket member 4 and a male plug member 5.

The buckle 1 and all of its component parts can be preferably molded from a plastic or a resin, but any suitable material known in the art for molding or machining buckles may be used.

In one embodiment, the socket member 4 can be integrally molded with a single strap attachment bar 6. Bar 6 is spaced away from the socket's main body so as to define space 7 (see FIG. 1) for receiving the strap. A strap (not illustrated) can be looped around the bar 6 and then secured to itself to attach the strap to the socket member 4. Plug member 5 can be integrally molded with a pair of cross bars 2 and 3 near one end, which can receive a strap in a known manner such that the strap is adjustable, for example, as described in U.S. Pat. No. 5,216,786.

The number and arrangement of the cross bars is not critical, and the layout may be adjusted for different applications. For example, a pair of cross bars may be provided in lieu of the single bar 6 on the socket member 4 to allow for adjustability of the strap attached to the socket member, or the plug member 5 may be provided with only a single cross bar if adjustability of the straps attached to the plug members is not required or desired.

Figure 5:
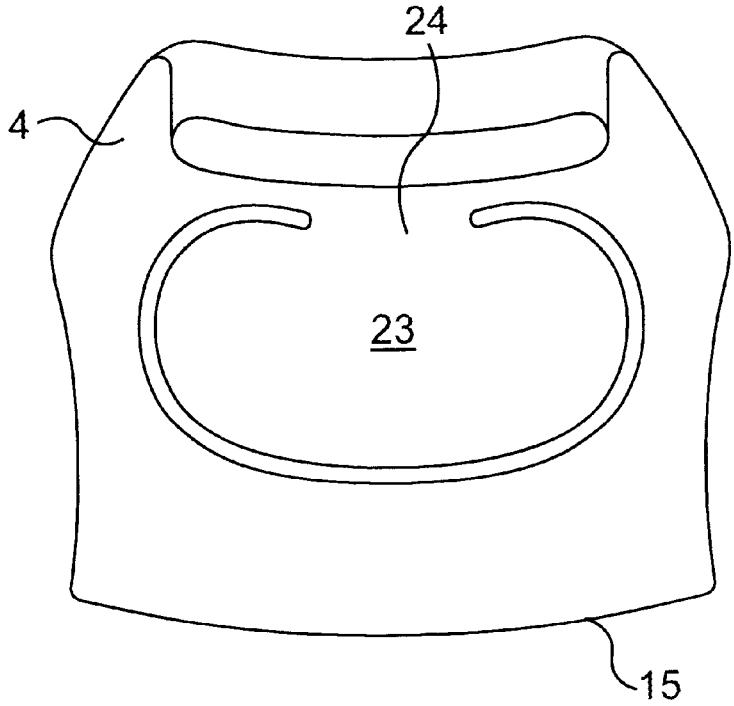
FIG. 5 is a top plan view of a female socket portion of a buckle in accordance with the invention.
Figure 6:
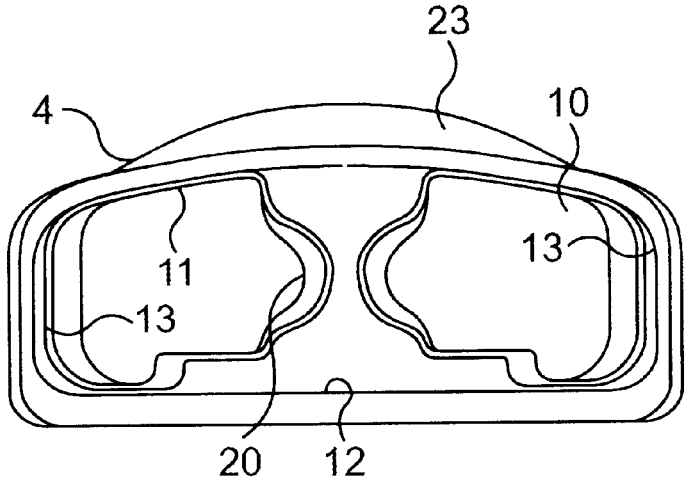
FIG. 6 is a front elevation view of the female socket shown in FIG. 5.

The socket member 4 preferably can have a substantially flat rectangular tubular cross-section as illustrated in FIGS. 5 and 6, and can include a substantially rectangular interior cavity 10. The cavity 10 is delimited in part by a top wall 11, an opposing bottom wall 12 and a pair of side walls 13, each of which connects the top wall 11 to the bottom wall 12. The top and bottom walls 11 and 12 are typically much wider than the side walls 13, so that the socket member has a substantially flat rectangular shape.

Figure 3:
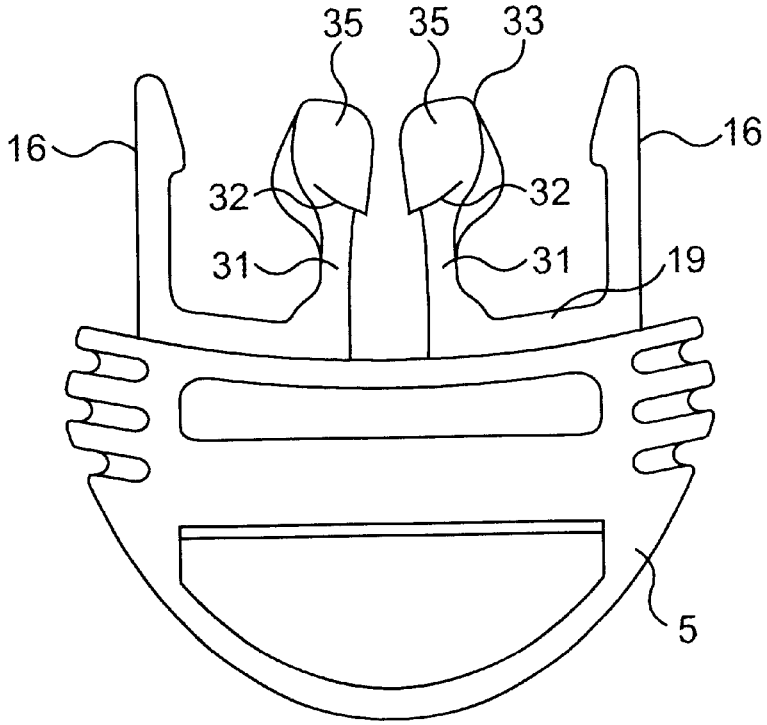
FIG. 3 is a top plan view of a male plug portion of a buckle in accordance with the invention.
Figure 4:
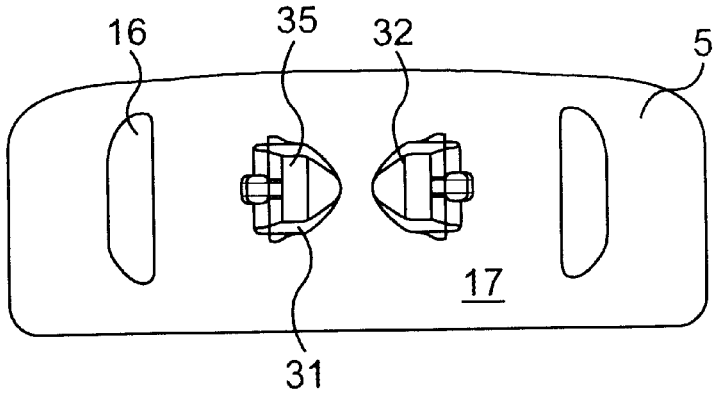
FIG. 4 is a front elevation view of the male plug shown in FIG. 3.

The plug member 5 shown in FIGS. 3 and 4, can be received and releasably locked within the cavity 10 of the socket member 4 via latching surfaces 32, formed on locking legs 31, which extend from the main body of plug member 5. The socket member 4 defines an opening 15 at one end thereof, which opens the socket member to the interior cavity 10. Opening 15 permits the socket member 4 to receive a portion of the plug member 5 in cavity 10, for coupling the plug member 5 to the socket member 4.

Figure 7:
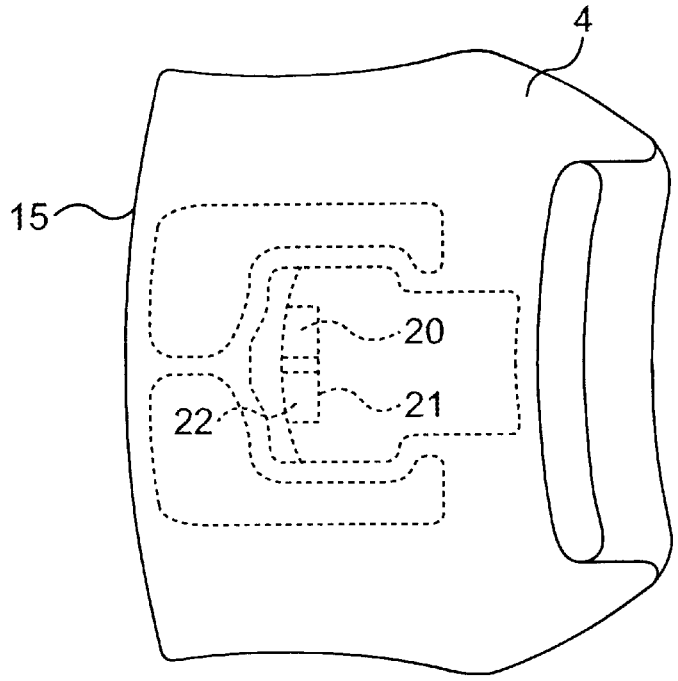
FIG. 7 is a top plan view of the female socket shown in FIG. 5, showing the internal structure in dashed lines.
Figure 8:
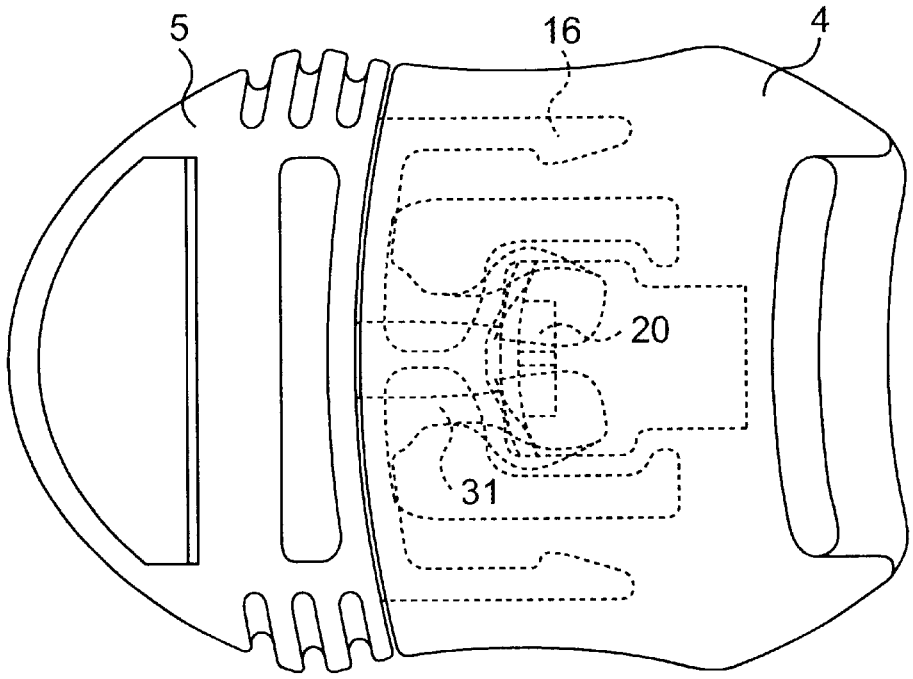
FIG. 8 is a top plan view of the buckle illustrated in FIG. 1, showing the internal structure in dashed lines.

A stopping post 20 shown in FIGS. 7 and 8 can be provided to retain and lock the plug member 5 in the socket member 4. Stopping post 20 can extend between the inner surfaces of the top and bottom walls 11 and 12 in the vicinity of the opening 15 of the socket member 4. Stopping post 20 defines an engaging surface 21 which faces toward the interior of cavity 10, and a pair of angled surfaces 22 oriented at an angle to surface 21. Surfaces 22 are shaped in a complementary manner to latching surfaces 32 of plug member 5.

In the exemplary embodiment shown in FIGS. 5 and 6, a movable push button 23 is formed on the top wall 11 of the socket member 4. The push button 23 can be coupled to the socket member 4 by a spring-like mechanism that returns push button 23 to its original position after it has been pressed and released. For example, a resilient portion 24 can connect push button 23 to the top surface of socket member 4. When applying a force to deflect push button 23 towards cavity 10 of socket member 4, the resilient portion 24 is bent. However, resilient portion 24 can be made of an elastic or of a shape memory material, so that when the force is removed, resilient portion 24 returns to its original shape, bringing push button 23 to the original position.

This configuration of resilient portion 24 is only exemplary, and other shape memory members may be used to attach the push button 23 to the socket member 4. For example, a single or a pair of leaf springs may be used to connect push button 23 to one or both of the side walls 13, or to bottom wall 12. Other types of springs and devices for actuating push buttons or the like may be used with push button 23, so that after being pushed downward into the interior cavity 10, pushbutton 23 resumes its original position once force on the button is removed.

Figure 9:
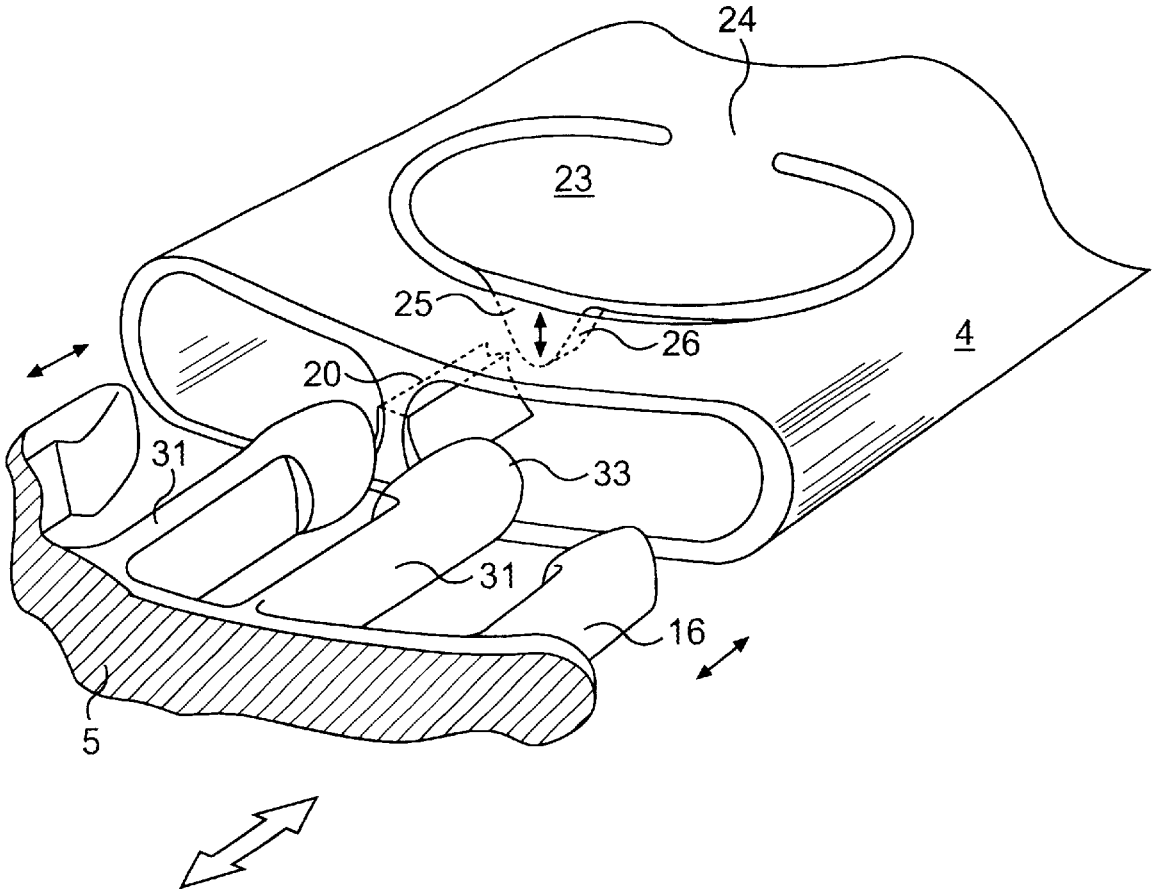
FIG. 9 is a perspective view of a buckle in accordance with an embodiment of the invention.
Figure 10:
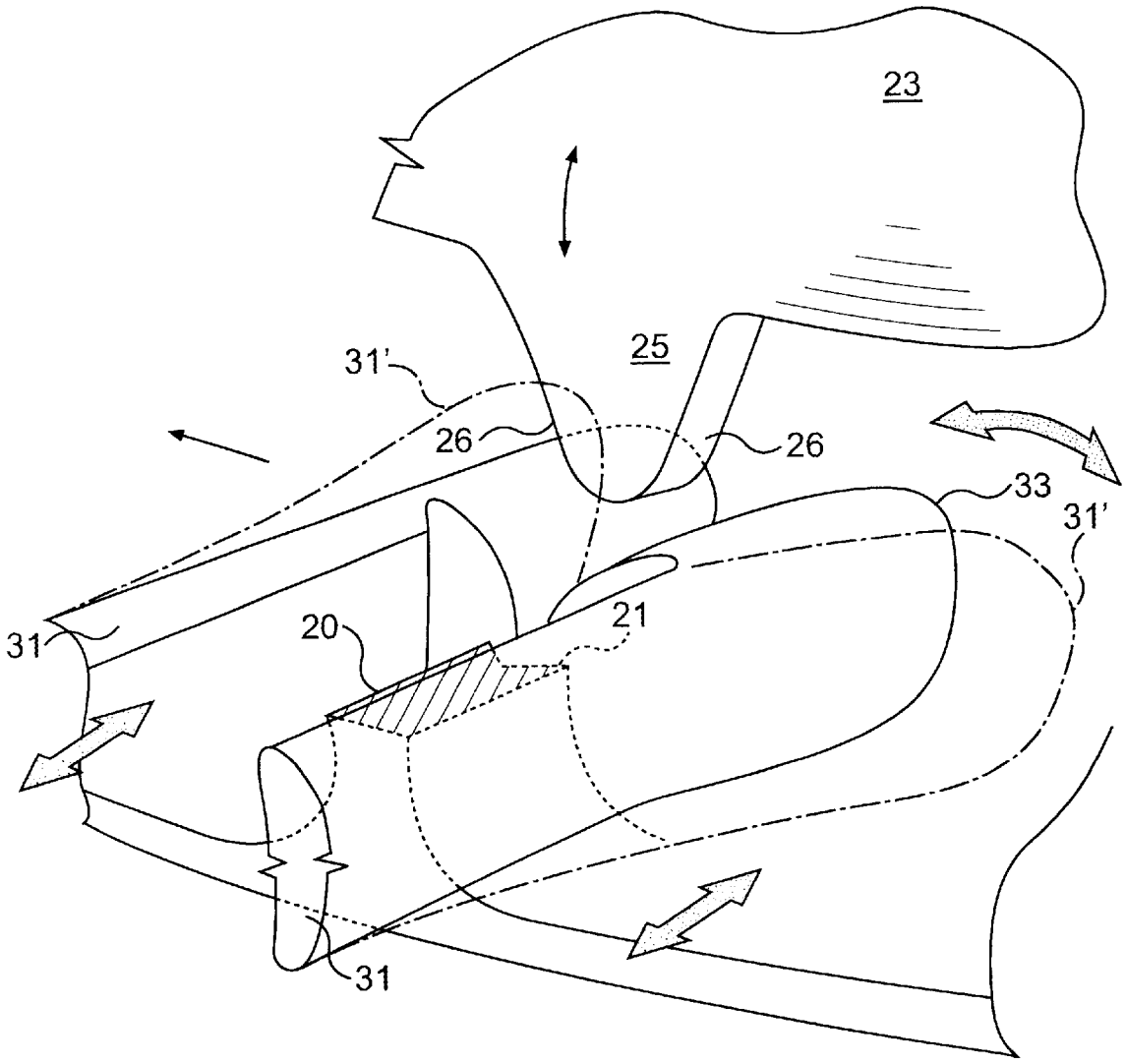
FIG. 10 is a perspective view showing a detail of the buckle shown in FIG. 9.

In the exemplary embodiment, push button 23 can be provided with a disengaging member 25 which projects from the button 23 into the interior cavity 10 of the socket member 4, as shown in FIGS. 9 and 10. The disengaging member 25 defines a pair of angled surfaces 26, at its distal end, which face toward the center of interior cavity 10. The surfaces 26 are tapered in the direction from the push button 23 toward the center of interior cavity 10, and preferably form an apex.

To ensure straight vertical movement of the push button 23 and proper positioning of the disengaging member 25 as the push button 23 is pushed down into the interior cavity 10, the socket member 4 can be provided with guides. The guides cooperate with the push button 23 to prevent misalignment, as the push button 23 is pushed downward. These guides can have the form of ribs, projections, or other known structures.

Figure 11A:
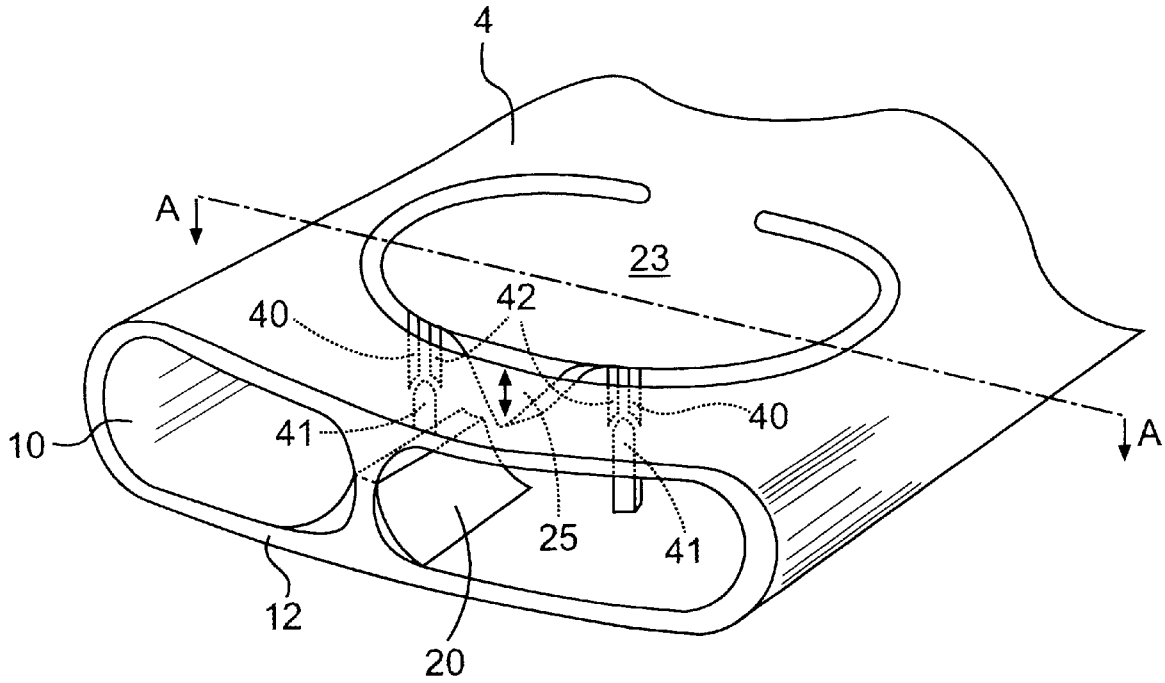
FIG. 11A is a top plan view of a buckle according to an embodiment of the invention, showing guide walls and guide channels in order to guide the downward movement of the button.
Figure 11B:
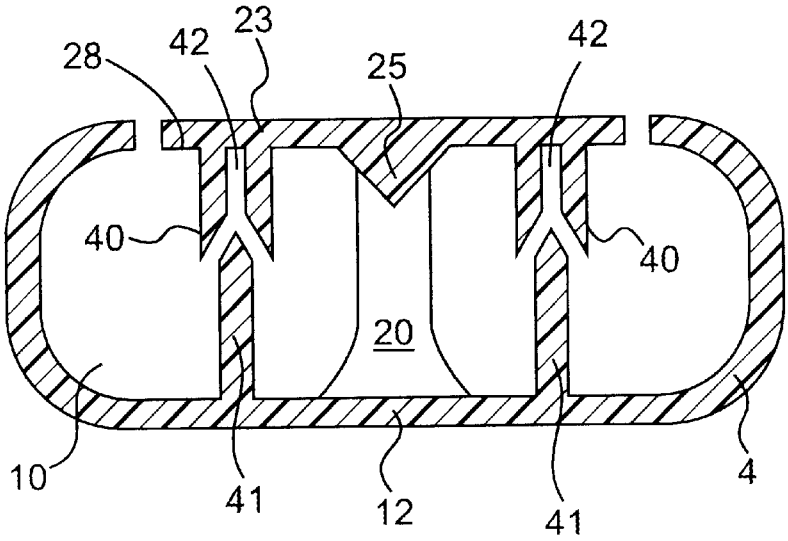
FIG. 11B is a cross-sectional view of the buckle according to the embodiment of the invention along the line A—A of FIG. 11A.

As shown in FIGS. 11A and 11B, guides 40 direct movement of the disengaging member 25 toward the locking legs 31. The guides 40 can, for example, include guide walls 41 projecting upwardly from the bottom wall 12 of the socket member 4, into the cavity 10, and guide channels 42 formed on an inner surface 28 of the button 23. The guide channels 42 can be adapted to receive the guide walls 41 upon depression of the button 23.

Plug member 5 according to this embodiment is provided with a pair of locking legs 31 projecting from base 17. As shown in FIGS. 3 and 4, the locking legs 31 are preferably integrally formed with the base portion 17 of the plug member 5, and are relatively thin as compared to the full length of the base portion 17. In this way, the locking legs 31 can be made flexible, but because they are integrally molded with the base portion 17, they are resilient enough to exhibit shape memory, i.e. they will return to their original position after a force bending them is removed. Each locking leg 31 defines a latching surface 32, preferably formed near the distal end 33 of the leg. In an exemplary configuration, latching surface 32 can be substantially perpendicular to the insertion direction of the plug member 5, and to the longitudinal axis of the leg 31. Latching surface 32 can thus engage the engagement surface 21 of the post 20 in the socket member 4, when the plug member 5 is fully inserted into the socket member 4.

To facilitate guiding the plug member 5 as it is inserted into the cavity 10 of the socket member 4, plug member 5 can be provided with a pair of guide legs 16, shown in FIGS. 3 and 4, which project from a base portion 17 of the plug member 5 in a direction generally parallel to each other. The guide legs 16 are spaced far apart from one another such that when inserted into the cavity 10 of the socket member 4, they contact the inner surface of the side walls 13 of the socket member 4. In this way, the cooperation between the guide legs 16 and the side walls 13 guides the plug member 5 to a proper position and fit within the socket member 4.

The guide legs 16 also function to help prevent lateral movement and sway of the plug member 5 when it is coupled to the socket member 4, since lateral movement of guide legs 16 is restricted by the confines of the side walls 13.

Guide legs 16 can have a height that places them in contact with the top and bottom walls 11 and 12 of the socket member 4 when inserted into the socket member. This prevents vertical movement and sway of the plug member 5 when it is coupled to the socket member 4. A fitting member 19 may also be provided near the base 17 of plug member 5, that can be sized so as to fit snugly within the top and bottom walls 11 and 12 of the socket member 4, for preventing vertical movement and sway of the plug member 5 when coupled to the socket member 4.

The procedure to couple plug member 5 to the socket member 4 is described with reference to FIGS. 8–10. The guide legs 16 and locking legs 31 of the plug member 5 are inserted into opening 15 in the socket member 4. The position of guide legs 16, ensures that the locking legs 31 will be guided around post 20, on opposite sides thereof. As the legs 31 are inserted into the cavity 10, the distal bulbous region 33 of each leg makes contact with one of the inclined surfaces 22 of the post 20. As the legs 31 are forced around the inclined surfaces 22 by continued insertion of the legs 31 into the cavity 10, legs 31 will diverge apart because of the divergent shape of surfaces 22.

The flexible nature of the locking legs 31 permits them to follow the shape of the surfaces 22. This is shown in FIG. 10 as a dashed line indicating the divergent position of locking legs 31'. The divergence of legs 31 continues until latching surfaces 32 clear the end of the post 20, at which point the legs 31 can snap back inward, thereby engaging the latching surfaces 32 on the engagement surface 21 of the post 20.

The resilient, shape memory nature of the legs 31 causes them to snap back after the latching surfaces 32 clear the post 20. Locking legs 31 are designed so that when the latching surfaces 32 engage the engagement surface 21, the guide legs 16 and the locking legs 31 will be fully inserted into the socket member 4, and the plug member 5 will be coupled to the socket member 4. The engagement of the latching surfaces 32 and engagement surface 21 locks the plug member 5 to the socket member 4, and prevents separation of the buckle pieces.

To disengage plug member 5 from the socket member 4, the push button 23 is depressed. As push button 23 moves downward, the disengaging member 25 is forced downward so as to push inclined disengaging surfaces 26 into contact with surfaces 35 of the bulbous distal ends 33 of the locking legs 31, as shown in FIGS. 9 and 10. Continued downward movement of the push button 23 forces the locking legs 31 to flex and diverge laterally outward, due to the interaction between angled surfaces 26 and angled faces 35 formed at the ends of the locking legs 31. The legs 31 continue to be forced laterally outward until the latching surfaces 32 clear the engagement surface 21 of the post 20. At such time, the bulbous distal ends 33 of the legs 31 slide along the inclined surfaces 22 of the post 20, and the resilient shape memory nature of the locking legs 31 causes them to return to their original, non-flexed position, so that the plug member 5 springs out of the socket member 4. In this embodiment, locking legs 31 are pushed by disengaging member 25 in a plane perpendicular to the plane of motion of the disengaging member 25.

Due to the shape memory nature of the resilient portion 24 that connects the push button 23 to the socket member 4, the push button 23 returns to its original, non-depressed position after pressure on the button is removed. Guides can be provided to restrict lateral movement of the pushed button 23 and of the disengaging member 25, so that as the button 23 is pushed downward, the disengaging member 25 is properly aligned with the distal ends 33 and the surfaces 35 of the locking legs 31.

The number and arrangement of posts 20 provided in the socket member 4 of the buckle is not critical, and may vary. For example, two posts may be provided, wherein each post engages just one of the two locking legs. Alternatively, a single post may be provided that includes two engaging surfaces, each of which engages one of the locking legs. The direction in which the locking legs 31 flex when engaging and disengaging the post is also not critical, and may vary from the direction described above. For example, the posts, their engaging surfaces, the locking legs and their latching surfaces may readily be reconfigured such that the locking legs are forced closer together (i.e., converge) when inserted into the socket member, rather than diverge as in the embodiment described above. In this variation, upon actuation of the push button 23, the locking legs will converge in order to disengage their latching surfaces from the engagement surfaces on the post.

As shown in FIG. 10, the engaging surface 21 of the stopping post 20 can have a V-shape, designed to more securely lock the latching surfaces 32 of the locking legs 31. In this embodiment, the latching surfaces 32 have a shape complementary to that of the V-shaped engaging surface 21. In addition, as shown, the latching surface 32 of each locking leg 31 of the plug member can extend around a top, a side and a bottom of the distal end 33 of the locking leg 31. This configuration allows the coupled buckle to withstand a greater pulling force without separating.

In the foregoing specification, exemplary embodiments of the invention have been described. Various modifications and changes may be made thereunto without departing from the broader spirit and scope of the invention as set forth in the appended claims and in their equivalents.

What is claimed is:

1. A buckle comprising:

a plug member having a base portion;

at least one resiliently flexible locking leg extending from the base portion of the plug member, each of the at least one resiliently flexible locking legs defining a latching surface, and each of the at least one resiliently flexible locking legs permitting movement of the latching surface in at least one first direction;

a socket member defining a cavity therein and an opening to the cavity;

a stopping post extending into the cavity from a surface of the socket member, said stopping post defining an engaging surface;

a disengaging member linked to the socket member, such that the disengaging member is movable in a second direction within the cavity of the socket member, the second direction being non-parallel to the at least one first direction, wherein the at least one locking leg is adapted to slidably enter the cavity of the socket member through the opening, to deflect around an angled surface of the stopping post, and to engage the latching surface with the engaging surface of the stopping post, so as to couple the plug member to the socket member, and wherein the disengaging member is adapted to disengage the latching surface of the at least one locking leg in the first direction from the engaging surface of the stopping post through movement of the disengaging member in the second direction, and thereby permit decoupling of the plug member from the socket member.

2. The buckle according to claim 1, wherein the disengaging member further comprises disengaging surfaces adapted to cooperate with angled surfaces formed on the at least one locking leg to disengage the latching surface of the at least one locking leg from the engaging surface of the stopping post.

3. The buckle according to claim 1, further comprising a button resiliently pivotable from a surface of the socket member, adapted to push the disengaging member in the second direction towards the at least one locking leg.

4. The buckle according to claim 3, wherein the button is connected to the disengaging member adapted to force the at least one locking leg of the plug member away from the stopping post in the first direction upon depression of the button in the second direction, so as to disengage the latching surface of the at least one locking leg in the first direction from the engaging surface of the stopping post.

5. The buckle according to claim 3, wherein the button is coupled to a surface of the socket member by at least one resiliently bendable portion.

6. The buckle according to claim 3, further comprising guides to direct movement of the disengaging member toward the at least one locking leg.

7. The buckle according to claims 6, wherein the guides include guide walls projecting upwardly from a bottom surface of the socket member, into the cavity, and guide channels formed on an inner surface of the button, said guide channels being adapted to receive the guide walls upon depression of the button.

8. The buckle according to claim 1, wherein the stopping post further comprises an angled surface adapted to deflect the at least one locking leg around the stopping post during coupling of the plug member to the socket member.

9. The buckle according to claim 1, wherein the plug member has a pair of resiliently flexible locking legs extending from the base portion of the plug member, each of said legs defining a latching surface thereon.

10. The buckle according to claim 1, wherein the latching surface of the at least one locking leg of the plug member is formed along a side of the at least one locking leg.

11. The buckle according to claim 10 , wherein the latching surface of the at least one locking leg is transverse to a longitudinal axis of the leg.

12. The buckle according to claim 1, wherein the latching surface defined on the at least one locking leg of the plug member is substantially V shaped.

13. The buckle according to claim 1, wherein the latching surface of the at least one locking leg of the plug member extends around a top and a bottom of the at least one locking leg.

14. The buckle according to claim 13, wherein the latching surface further extends around a side of the at least one locking leg.

15. The buckle according to claim 13, wherein the latching surface defines an apex extending from a side of the at least one locking leg.

16. The buckle according to claim 15, wherein the stopping post defines a substantially V-shaped engaging surface, adapted to cooperate with the substantially V-shaped latching surface of the at least one locking leg.

17. The buckle according to claim 1, wherein the plug member further comprises at least one guide leg adapted to contact an inner surface of the socket member when the plug member is coupled to the socket member.

18. The buckle according to claim 17 ,wherein the plug member further comprises a pair of guide legs projecting from the base portion, wherein each of the pair of guide legs contacts an inner surface of the socket member, when the plug member is coupled to the socket member.

* * * * *

UNITED STATES PATENT AND TRADEMARK OFFICE

CERTIFICATE OF CORRECTION

PATENT NO. : 6,446,314 B1
DATED : September 10, 2002
INVENTOR(S) : Joseph Anscher It is certified that error appears in the above-identified patent and that said Letters Patent is hereby corrected as shown below:

Title page,
Item [57], ABSTRACT,
Line 3, please delete "formed on in resiliently" and insert -- formed on resiliently --.

Signed and Sealed this

Seventh Day of September, 2004

JON W. DUDAS
*Director of the United States Patent and Trademark Office*